US009195249B2

(12) United States Patent
Chen et al.

(10) Patent No.: US 9,195,249 B2
(45) Date of Patent: Nov. 24, 2015

(54) ADAPTIVE PHASE-LEAD COMPENSATION WITH MILLER EFFECT

(75) Inventors: Sean S. Chen, Sunnyvale, CA (US); Liwei Liu, San Jose, CA (US); Yongliang Wang, Saratoga, CA (US)

(73) Assignee: Atmel Corporation, San Jose, CA (US)

( * ) Notice: Subject to any disclaimer, the term of this patent is extended or adjusted under 35 U.S.C. 154(b) by 1008 days.

(21) Appl. No.: 13/332,142

(22) Filed: Dec. 20, 2011

(65) Prior Publication Data

US 2013/0154593 A1 Jun. 20, 2013

(51) Int. Cl.
*G05F 1/56* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/565; G05F 1/575; G01R 15/207; H02M 2001/0009
USPC ..... 323/265, 273–275
See application file for complete search history.

(56) References Cited

U.S. PATENT DOCUMENTS 5,808,516 A * 9/1998 Barber ..... 330/282
6,603,292 B1 * 8/2003 Schouten et al. ..... 323/277

* cited by examiner

*Primary Examiner* — Adolf Berhane
*Assistant Examiner* — Yemane Mehari
(74) *Attorney, Agent, or Firm* — Fish & Richardson P.C.

(57) ABSTRACT

An adaptive phase-lead compensation (zero) circuit is disclosed that can be added to a circuit (e.g., a CMOS-based LDO) to ease the compensation and increase the phase margin of the circuit. By using the disclosed adaptive phase-lead compensation circuit, an adjustable resistance can be connected to any nodes in the compensated circuit rather than just to the voltage source (VDD) or ground (GND), allowing the Miller Effect to be used via a Miller capacitor.

5 Claims, 3 Drawing Sheets

ADAPTIVE PHASE-LEAD COMPENSATION WITH MILLER EFFECT

TECHNICAL FIELD

This disclosure relates generally to electronics and more particularly to adaptive phase-lead compensation of electronic circuits.

BACKGROUND

In low-dropout linear regulator (LDO) design, especially a design with high power supply ripple rejection (PSRR) and low noise product, compensation becomes more difficult due to high open-loop gain and limited pole and pole separation. A known approach to this problem is to use an adaptive phase-lead compensation circuit that includes a capacitor in series with a resistor, such that the capacitor provides the Miller Effect and the resistor provides a fixed zero in the frequency domain. This approach, however, does not enhance the phase margin much because the load current is not fixed, especially when a no load condition is presented. Another known approach is to use a transistor (e.g., PMOS) to sense the load current so it can work as an adaptive resistance connected to a voltage supply (VCC). The drawback of this approach is that the Miller Effect cannot be used.

SUMMARY

An adaptive phase-lead compensation (zero) circuit is disclosed that can be added to a circuit (e.g., a CMOS-based LDO) to ease the compensation and increase the phase margin of the circuit. By using the disclosed adaptive phase-lead compensation circuit, an adjustable resistance can be connected to any nodes in the compensated circuit rather than just to the voltage source (VDD) or ground (GND), allowing the Miller Effect to be used via a Miller capacitor. The adaptive phase-lead compensation circuit does not require a special fabrication process (e.g., Vt implant) to implement in a design.

Particular implementations of adaptive phase-lead compensation with Miller Effect can provide several advantages, including: 1) providing a load-adaptive zero to track load conditions; 2) providing the Miller Effect for compensation to improve efficiency; and 3) providing a load-adaptive zero using a separate control on the gate of a transistor to provide adjustable resistance over a wide range of load current.

The details of one or more disclosed implementations are set forth in the accompanying drawings and the description below. Other features, aspects, and advantages will become apparent from the description, the drawings and the claims.

DETAILED DESCRIPTION

Example Circuit

Figure 1:
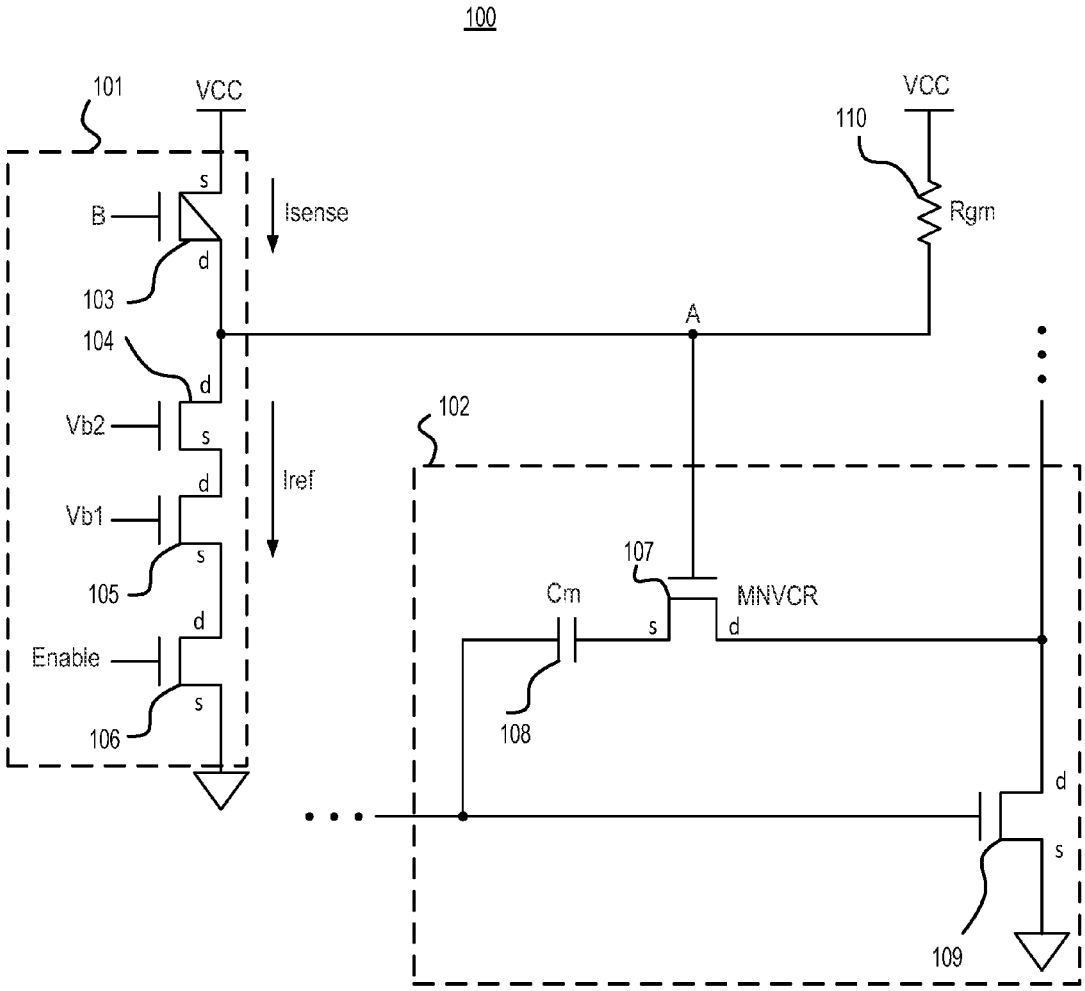
FIG. 1 is a simplified schematic diagram of an example circuit for providing adaptive phase-lead compensation with Miller Effect.

FIG. 1 is a simplified schematic diagram of an example circuit 100 for providing adaptive phase-lead compensation with Miller Effect. Circuit 100 can be used to compensate a variety of circuit designs, such as an LDO design. Circuit 100 can include current sensor 101 and compensation circuit 102. Current sensor 101 can include transistors 103, 104, 105 and 106 coupled in series. In FIG. 1, "s" means source terminal and "d" means drain terminal. Transistor 103 operates as a current mirror (current sense) whose gate can be coupled to the gate of a larger PMOS transistor. Transistors 104, 105 are a cascaded current source, which operates as a mirroring branch of reference current. Transistor 106 is an enable device, which powers down the current sensor 101 when not used. In some implementations, transistor 103 can be p-type metal-oxide-semiconductor (PMOS) field-effect transistor and transistors 104-106 can be NMOS field-effect transistors.

Compensation circuit 102 can include voltage controlled resistor (VCR) 107 (MNVCR), compensation capacitor 108, transistor 109 and resistor 110 (Rgm). In the example circuit shown, MNVCR 107 is a gate-biased transistor, which operates as a VCR. In some implementations, MNVCR 107 can be an n-type metal-oxide-semiconductor field-effect (NMOS) transistor having a gate terminal coupled between transistors 103, 104 and to resistor 110. A source terminal of MNVCR 107 can be coupled to compensation capacitor 108 and a drain terminal of MNVCR 107 can be coupled to a drain terminal of transistor 109.

Transistor 109 can be a NMOS transistor with its source coupled to ground. It is a common-source (CS) stage, which is required to provide a high negative gain so that Miller Effect can be in place. Transistor 109 can be part of gain stages in any analog applications.

The gate terminal of MNVCR 107 (node A) is configured to track the load current through current sensor 101, so that a resistance that is linearly proportional to the load current is created by MNVCR 107. Resistor 110 converts (Isense-Iref) to a control voltage on the gate of MNVCR 107. Resistor 110 also sets the voltage range over which the gate of MNVCR 107 can vary. When load current is high, Isense is higher than Iref and the voltage of node A becomes higher. When the voltage of node A becomes higher the resistance of MNVCR 107 is reduced, resulting in the zero (in the frequency domain) provided by MNVCR 107 being pushed to a higher frequency. This higher frequency is needed for high current load conditions. When load current is low, Isense is lower than Iref and the voltage of node A becomes lower, which increases the resistance of MNVCR 107. This results in the zero provided by MNVCR 107 being pushed to a lower frequency. This lower frequency is needed for low current load conditions. With this "adaptive zero" provided by the varying resistance of MNVCR 107, a wide load current range can be accommodated.

Figure 2:
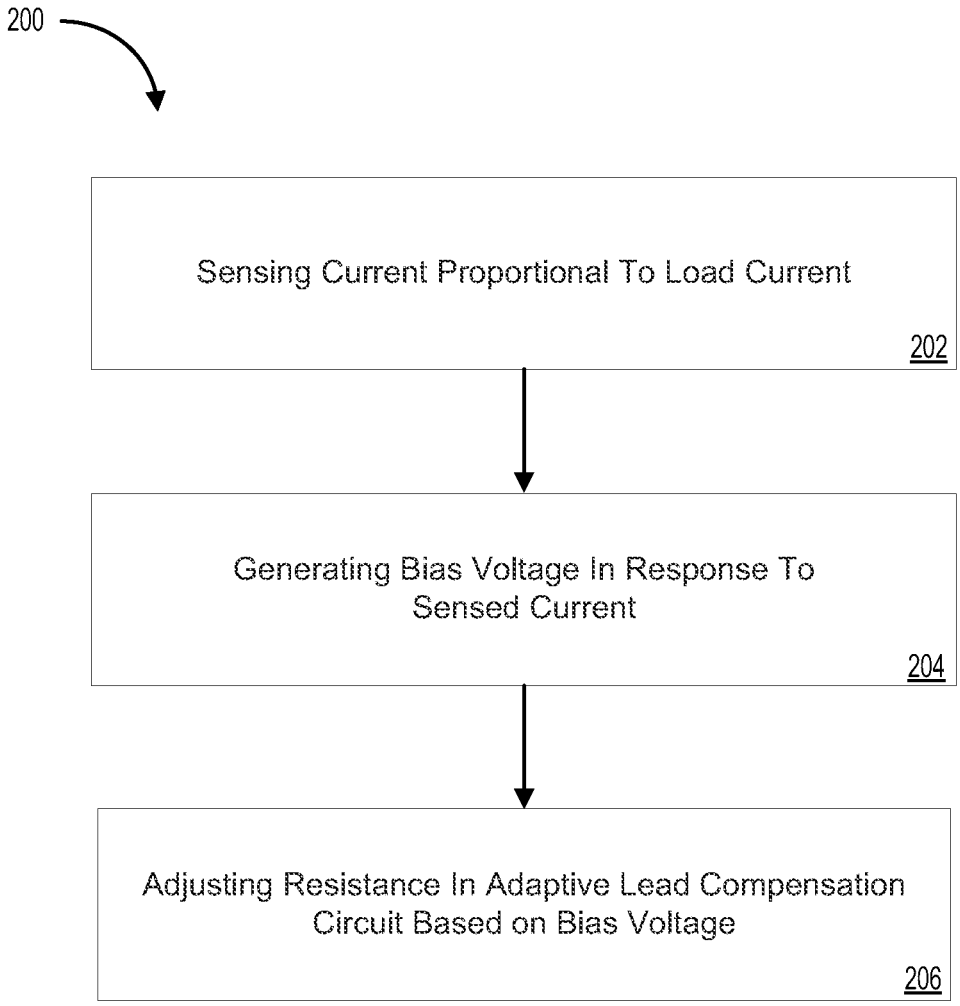
FIG. 2 is a flow diagram of an example process for providing adaptive phase-lead compensation.

FIG. 2 is a flow diagram of an example process 200 for providing adaptive phase-lead compensation with Miller Effect. In some implementations, process 200 can begin by sensing load current proportional to load current (202). This can be done with a current sensor, such as current sensor 101 shown in FIG. 1.

Process 200 can continue by generating a bias voltage in response to the sensed current (204). This can be done using a current sensor, such as the current sensor 101 shown in FIG. 1.

Process 200 can continue by adjusting resistance in an adaptive phase-lead compensation circuit based on the bias voltage (206), such as the compensation circuit 102 shown in FIG. 1. For example, a bias voltage can be applied to the gate of a transistor coupled to a Miller capacitor to adjust its resistance as the load current changes. In some implementations, the transistor can be an NMOS transistor. An additional resistor can be coupled to the gate of the transistor to set the voltage range over which the gate of the transistor can vary.

Figure 3:
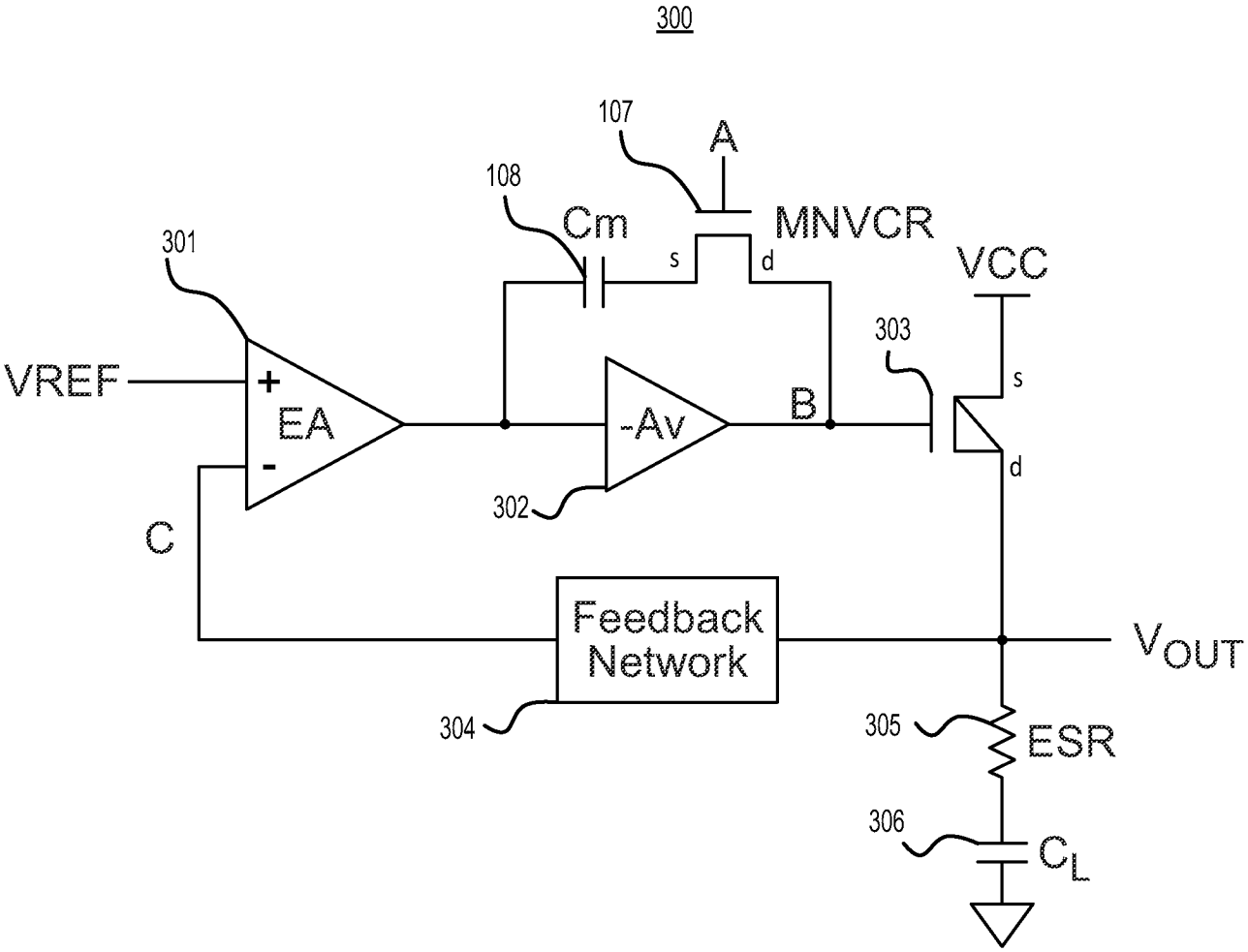
FIG. 3 is a simplified schematic diagram of an LDO circuit with adaptive phase-lead compensation, as described in reference to FIGS. 1 and 2.

FIG. 3 is a simplified schematic diagram of an LDO circuit 300 with adaptive phase-lead compensation, as described in reference to FIGS. 1 and 2. In some implementations, LDO circuit 300 can include error amplifier 301 (EA), amplifier 302, feedback network 304, transistor 303, resistor 305 (ESR), capacitor 306 (CL), compensation capacitor 108 (Cm) and MNVCR 107. Node "A" (the gate of MNVCR 107) is coupled to the current sensor 101, described in reference to FIG. 1. The drain of MNVCR 107 is coupled to the gate of transistor 103 of current sensor 101.

The gate of transistor 303 (node "B") is biased such that the voltage of inverting input (node "C") of error amplifier 301 equals to VREF voltage. The voltage at node "C" is a voltage coupled from Vout through feedback network 304, which can be a resistive network.

MNVCR 107 and compensation capacitor 108 provide adaptive phase-lead compensation by adjusting the resistance of MNVCR 107 based on a bias voltage provided to node "A" by current sensor 101 of FIG. 1.

While this document contains many specific implementation details, these should not be construed as limitations on the scope what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A circuit comprising:

a current sensor configured for sensing load current of the circuit;

a compensation circuit coupled to the current sensor and configured for providing an adaptive compensating zero for the circuit in response to changes in load current detected by the current sensor, wherein the compensation circuit includes:

a voltage controlled resistor configured to change its resistance in response to changes in a bias voltage;

a compensation capacitor coupled to the voltage controlled resistor configured to provide a Miller Effect based on the resistance; and a resistor coupled to the voltage controlled resistor and a voltage supply, the resistor providing the bias voltage and setting a voltage range over which the voltage controlled resistor can vary.

2. The circuit of claim 1, wherein the voltage controlled resistor is an n-type metal-oxide-semiconductor field-effect (NMOS) transistor.

3. The circuit of claim 1, further comprising a low dropout linear regulator coupled to the circuit.

4. A system comprising:

a low dropout linear regulator;

a current sensor configured for sensing load current of the circuit;

a compensation circuit coupled to the current sensor and the low dropout linear regulator, the compensation circuit configured for providing an adaptive compensating zero for the low dropout linear regulator in response changes in load current detected by the current sensor, wherein the compensation circuit includes:

a voltage controlled resistor configured to change its resistance in response to changes in a bias voltage;

a compensation capacitor coupled to the voltage controlled resistor and configured to provide a Miller Effect based on the resistance; and a bias circuit coupled to the voltage controlled resistor and a voltage supply, the bias circuit configured for providing the bias voltage and setting a voltage range over which the voltage controlled resistor can vary.

5. The system of claim 4, wherein the voltage controlled resistor is an n-type metal-oxide-semiconductor field-effect (NMOS) transistor.

* * * * *